US006868825B2

(12) United States Patent
Suzuki

(10) Patent No.: US 6,868,825 B2
(45) Date of Patent: Mar. 22, 2005

(54) THROTTLE VALVE APPARATUS

(75) Inventor: Yasuhiro Suzuki, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/639,581

(22) Filed: Aug. 13, 2003

(65) Prior Publication Data

US 2004/0041117 A1 Mar. 4, 2004

(30) Foreign Application Priority Data

Aug. 29, 2002 (JP) ..... 2002-251719

(51) Int. Cl.[7] ..... F02D 9/08
(52) U.S. Cl. ..... 123/337
(58) Field of Search ..... 123/337, 361, 123/399

(56) References Cited

U.S. PATENT DOCUMENTS 6,382,181 B2 * 5/2002 Wayama et al. ..... 123/399
6,626,421 B2 * 9/2003 Torii et al. ..... 251/305
6,691,681 B2 * 2/2004 Wayama et al. ..... 123/399

FOREIGN PATENT DOCUMENTS

JP 11-132061 5/1999

* cited by examiner

*Primary Examiner*—Mahmoud Gimie
(74) *Attorney, Agent, or Firm*—Nixon & Vanderhye PC

(57) ABSTRACT

A projecting portion, which projects from an outer surface of a bore portion, integrally has a full open stopper and a full close stopper. The full open stopper locks a throttle lever when a throttle valve is fully opened. The full close stopper locks the throttle lever when the throttle valve is fully closed. Moreover, the projecting portion has reinforcing rib portions for reinforcing the full open stopper and the full close stopper. Accordingly, the strength of the full open stopper and that of the close stopper are recovered each other, so that both stoppers can be downsized.

9 Claims, 4 Drawing Sheets

THROTTLE VALVE APPARATUS

CROSS REFERENCE TO RELATED APPLICATION

This application is based on Japanese Patent Application No. 2002-251719 filed on Aug. 29, 2002, the disclosure of which is incorporated herein by reference.

FIELD OF THE INVENTION

The present invention relates to a throttle valve apparatus for controlling the amount of air taken into an engine, particularly to the throttle valve apparatus, which includes a full open stopper and a full close stopper integrally formed in an outer wall of a bore portion of a throttle housing constituting an intake air passage and which can ensure strength of the full open stopper and the full close stopper.

BACKGROUND OF THE INVENTION

Heretofore, a well known throttle valve apparatus has a throttle valve, a full open stopper and a full close stopper. The throttle valve controls the amount of air taken into an engine. The full open stopper restricts rotation of the throttle valve in its first rotational direction when the throttle valve is fully opened. The full close stopper restricts the rotation of the throttle valve in its second rotational direction, which is opposite to the first rotational direction, when the throttle valve is fully closed. One of the throttle valve apparatus is disclosed in JP-A-H11-132061.

In the throttle valve apparatus, the full open stopper and the full close stopper respectively project from different positions of an outer surface of a bore portion of a throttle housing. The full open stopper receives excessive load when the throttle valve is fully opened. Moreover, the full close stopper receives the excessive load when the throttle valve is fully closed. Accordingly, each of the full open stopper and the full close stopper is required to be formed in a shape to be able to endure the load. Therefore, the full open stopper and the full close stopper are formed to be enlarged, so that the material cost is disadvantageously increased.

Moreover, when the bore portion, the full open stopper and the full close stopper are integrally formed by means of resin molding or metal casting, and unless wall thicknesses of which are formed uniformly, a delicate point, a void or a blow hole is likely to be formed therein. Accordingly, the full open stopper and the full close stopper disadvantageously reduce their performance and durability.

SUMMARY OF THE INVENTION

The purpose of the present invention is to provide a throttle valve apparatus having a downsized full open stopper and a downsized full close stopper each of which has enough strength, so that the material cost can be reduced, and the quality of the throttle housing can be enhanced. Moreover, the purpose is to provide the throttle valve apparatus, in which the performance of the full open stopper and the full close stopper is kept, and the durability of which is enhanced.

According to the invention, a throttle housing has a projecting wall outside a bore portion for storing a throttle valve openably and closably. Moreover, the throttle housing has a projecting portion, which projects outward from the peripheral surface of the projecting wall in its radial direction. Further, the projecting portion has a full open stopper and a full close stopper integrally. The full open stopper restricts rotation of the throttle valve in its first rotational direction when the throttle valve is fully opened. The full close stopper restricts the rotation of the throttle valve in its second rotational direction, which is opposite to the first rotational direction, when the throttle valve is fully closed. Since both stoppers are formed integrally, load to the full open stopper is shared to the full close stopper when the full open stopper is pressed by a throttle gear. Moreover, when the full close stopper is pressed by the throttle gear, the load to the full close stopper is shared to the full open stopper. Therefore, the strength of the full open stopper and that of the full close stopper are recovered each other. Accordingly, the full open stopper and the full close stopper need not be enlarged to ensure their strength. That is, the stoppers can be downsized, and the material cost can be reduced.

Moreover, according to the invention, the throttle housing is attached to an engine side component so that one side surface of the projecting portion, which is opposite from the full open stopper, should contact the engine side component. Accordingly, when the throttle valve is fully opened, the load from the throttle lever to the full open stopper is shared to the engine side component, so that the engine side component can essentially support the full open stopper. Therefore, the full open stopper can be downsized. Particularly, the reinforcing rib portion for reinforcing the full open stopper can be downsized.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE PRESENTLY PREFERRED EMBODIMENTS

Figure 1:
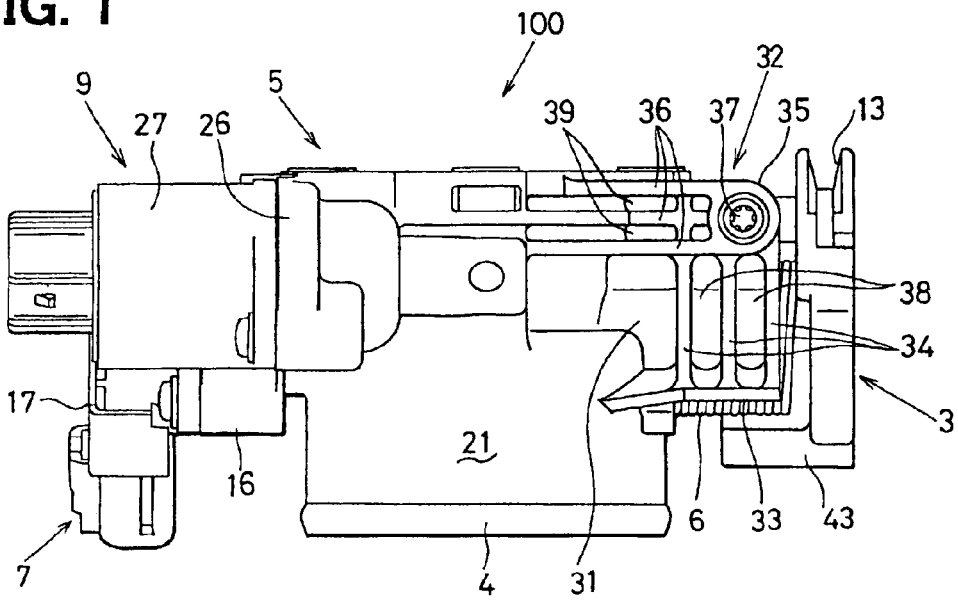
FIG. 1 is a plan view of a throttle valve apparatus according to the first embodiment of the present invention.
Figure 2:
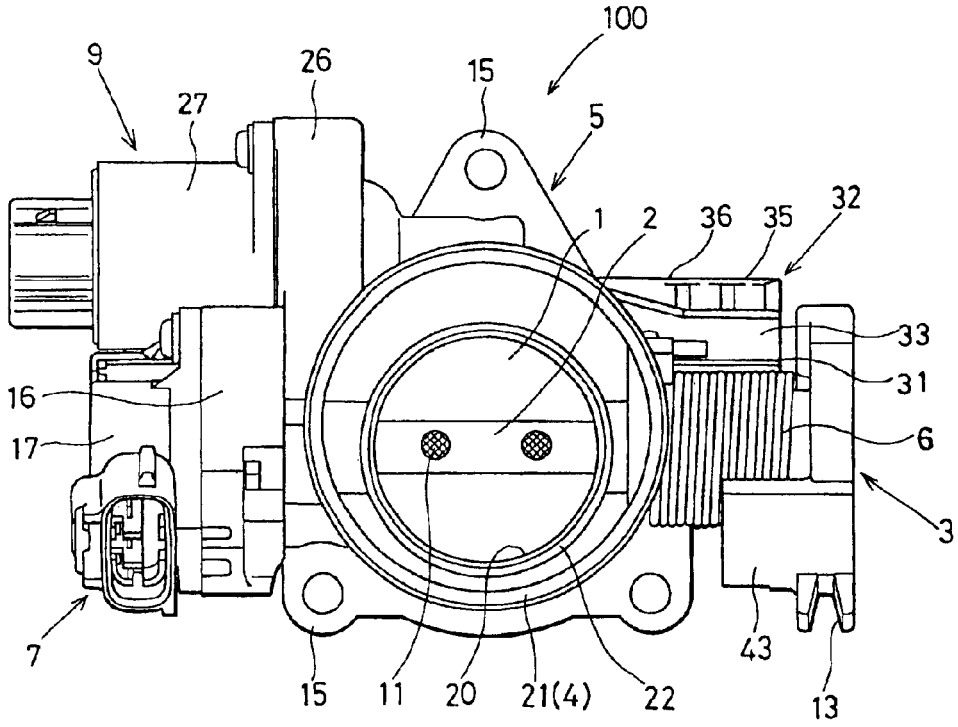
FIG. 2 is a front elevation view of the throttle valve apparatus.

Preferred embodiments of the present invention will be described hereinafter with reference to the accompanying drawings.

First Embodiment

A throttle valve apparatus 100 according to the first embodiment is described with reference to FIGS. 1 to 4A. The throttle valve apparatus 100 is for an engine of an automobile and controls the amount of air taken into the engine on the basis of a depressed degree of an accelerator pedal (not shown), so as to control rotational speed of the engine.

The throttle valve apparatus 100 includes a throttle valve 1, a throttle valve shaft 2, a throttle lever 3 and a throttle housing 5. The throttle valve shaft 2 revolves integrally with the throttle valve 1. The throttle lever 3 rotationally drives the throttle valve 1 and the shaft 2. Moreover, the throttle housing 5 has a cylindrical bore portion 4, which stores the throttle valve 1 and the shaft 2 openably and closably.

The throttle valve 1 is a disc-shaped and butterfly-shaped rotary valve made of a metal material or a resin material. The throttle valve 1 is inserted in a valve inserting hole (not shown) formed in the shaft 2 and thereafter fastened there by fastening members 11, such as setscrews. Moreover, the shaft 2 is rotatably supported by bearing portions (not shown) or shaft through holes (not shown) of the throttle housing 5 with the use of bearing members (not shown), such as dry bearings, thrust bearings and ball bearings. The shaft 2 is made of a metal material or a resin material with a stick-shape.

The throttle lever 3 is made of a metal material or a resin material and fastened to one end of the shaft 2 with the use of a fastening member 12, such as a fixing bolt and a washer. Moreover, a wire cable (not shown), which is driven in response to the operation of the accelerator pedal, is attached to a substantially V-shaped portion 13 of the throttle lever 3. On the side of the throttle lever 3, which opposes the bore portion 4, a bossy full open stopper portion 43 for contacting a full open stopper 33 and a bossy full close stopper portion 45 for contacting a full close stopper 35 are integrally formed. Moreover, a plurality of reinforcing rib portions 41, 42 and a plurality of scraped portions 44, 46 are integrally formed in both sides of the throttle lever 3.

Moreover, a coil-shaped return spring 6 is disposed between the throttle lever 3 and the throttle housing 5. The return spring 6 is for returning the throttle valve 1, shaft 2 and the throttle lever 3 to respective initial positions when the engine is in an idol rotational state. One end of the return spring 6 is supported by the periphery of the throttle lever 3, and the other end of that is supported by the periphery of the bore portion 4. The throttle housing 5 is a resin molded one, which is integrally made of a heatproof resin material and supports the throttle valve 1 and the shaft 2.

Attaching flanges 15 are formed around the most downstream end of the bore portion 4 in a flowing direction of intake air. The attaching flanges 15 are airtightly and integrally fastened to an attaching end surface of an intake manifold (not shown) of the engine with the use of a fastening member (not shown) such as a clasp and a pair of bolt and nut.

Moreover, a sensor case 16, which stores components of a throttle position sensor 7 for detecting the rotational angle of the throttle valve 1, is integrally formed in the peripheral surface of the throttle housing 5. A sensor cover 17 is fastened to the sensor case 16 with the use of a fastening member (not shown), such as a fixing bolt and a tapping screw. The sensor cover 17 covers the opening of the sensor case 16 and tightly fixes a detecting element (not shown) and an external connection terminal (not shown) of the throttle position sensor 7. The throttle position sensor 7 is attached to the other end of the shaft 2 and includes a rotor (not shown), a permanent magnet (not shown) and a detection element (a hall element or a magnetoresistive element). The permanent magnet is installed inside of the rotor and rotated integrally with the rotor for generating magnetic flux. The detection element is disposed around the rotor and detects the rotational angle (opening degree) of the throttle valve 1 in accordance with the magnetic flux of the permanent magnet.

When the throttle position sensor 7 detects the opening degree of the throttle valve 1, the detected opening degree is converted to a throttle opening degree signal and thereafter transmitted to an engine control unit (ECU). The throttle opening degree signal is one of the informational signals showing how much fuel is injected to the engine. The ECU determines how much the accelerator pedal is depressed on the basis of the throttle opening degree signal.

Figure 4A:
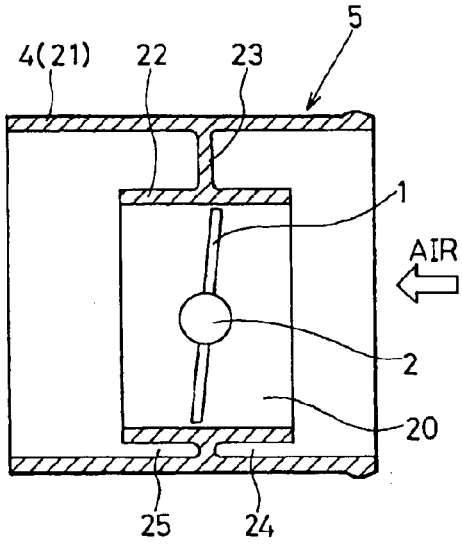
FIG. 4A is a cross-sectional view of a bore portion of the throttle valve apparatus.

As shown in FIG. 4A, the bore portion 4 has a double-piped structure, in which a cylindrical inner bore pipe 22 is disposed inside a cylindrical outer bore pipe 21. The outer bore pipe 21 has an air inlet port (not shown), through which the intake air from an air cleaner (not shown) through an air intake line (not shown) is taken, and an air outlet port (not shown), through which the intake air is sent to a surge tank (not shown) or the intake manifold of the engine.

The outer bore pipe 21 is integrally made of a heatproof resin, and its outer and inner diameters are formed substantially uniform in an airflow direction. Moreover, an intake air passage 20, through which the intake air flows into the engine, is formed in the Inner bore pipe 22. The throttle valve 1 and the shaft 2 are rotatably installed in the substantial center of the intake air passage 20. Further, an annular space between the outer bore pipe 21 and the inner bore pipe 22 is divided in a substantial center of the inner bore pipe 22 in the airflow direction by a dividing wall 23. Further, the upstream side of the annular space from the dividing wall 23 is a sealing concavity 24 for sealing water flowing thereinto through the inner surface of the air intake line. Furthermore, the downstream side of the annular space from the dividing wall 23 is a sealing concavity 25 for sealing the water flowing thereinto through the inner surface of the intake manifold.

Moreover, a bypass passage forming portion 26, having a bypass passage (not shown), is integrally formed on the upper wall of the outer bore pipe 21. The bypass passage is an air passage that bypasses the throttle valve 1. In the bypass passage, an idle rotational speed control valve 9 (ISC valve), which is driven by a stepping motor 27, is installed. The ISC valve 9 controls the amount of the air flowing in the bypass passage in order to control the idle rotational speed of the engine. Moreover, an outlet port of a positive crankcase ventilation (PCV) or a purge tube of an evaporation prevention system may be formed in the upper wall of the outer bore pipe 21. The PCV makes the blow-by gas reflow from a crank case to an air intake system, such as the intake manifold and the air cleaner, and reheat.

On the bore portion 4, a substantially arcuate projecting wall 31 and an integral projecting portion 32 are integrally formed of a heatproof resin. The projecting portion 32 partially covers one end of the shaft 2. The projecting portion 32 projects outward in the radial direction of the bore portion 4 from the peripheral surface thereof. The projecting portion 32 includes a full open stopper 33, reinforcing rib portions 34, a full close stopper 35 and reinforcing rib portions 36. The full open stopper 33 contacts the full open stopper portion 43 of the throttle lever 3 when the throttle valve 1 is fully opened. The reinforcing rib portions 34 reinforce the full open stopper 33. The full close stopper 35 contacts the full close stopper portion 45 of the throttle lever 3 when the throttle valve 1 is fully closed. The reinforcing rib portions 36 reinforce the full close stopper 35.

When the full open stopper 33 contacts the full open stopper portion 43, the further rotation of the throttle lever 3 in its first rotational direction is restricted. That is, the full open stopper 33 has a function to stop the rotation of the throttle valve 1 in its fully opened position. Moreover, when the full close stopper 35 contacts the full close stopper portion 45, the further rotation of the throttle lever 3 in its reverse rotational direction is restricted. That is, the full close stopper 35 has a function to stop the rotation of the throttle valve 1 in its fully closed positions. Further, a tapping screw 37 is engaged with the full close stopper 35 to control the fully closed position of the throttle valve 1.

Figure 3:
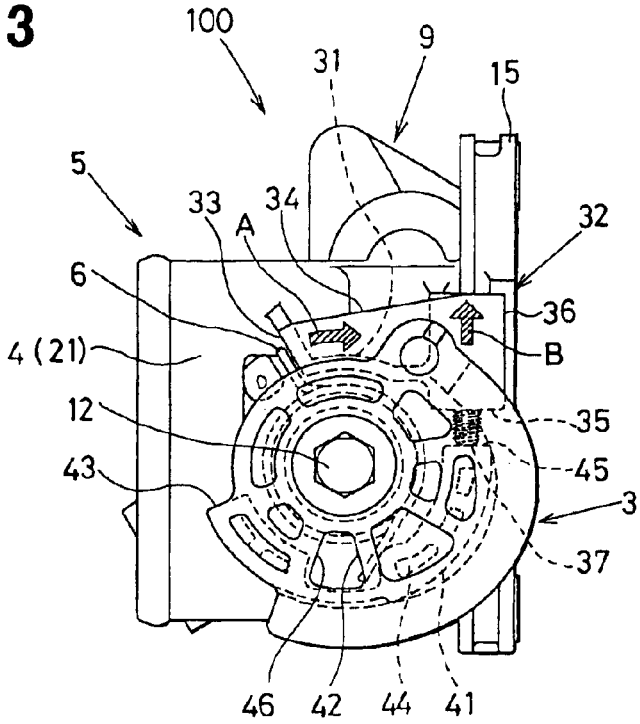
FIG. 3 is a side view of the throttle valve apparatus.

The reinforcing rib portions 34 are formed to be substantially extended in a direction indicated in an arrow A shown in FIG. 3, in which the full open stopper 33 receives the load from the throttle lever 3. Moreover, the reinforcing rib portions 36 are formed to be substantially extended in a direction indicated in an arrow B shown in FIG. 3, in which the full close stopper 35 receives the load from the throttle lever 3. The reinforcing rib portions 34, 36 integrally connect the full open stopper 33 and the full close stopper 35. Further, in the throttle housing 5, at least the projecting wall 31, the full open stopper 33, the reinforcing rib portions 34, the full close stopper 35 and the reinforcing rib portions 36 are formed with substantially uniform wall thicknesses. Therefore, a void or a blow hole is prevented from being formed, and molten resin or forging liquid uniformly reaches an entire mold cavity of the full open stopper and the full close stopper respectively.

Specifically, the full open stopper 33 projects outward from one peripheral end of the projecting wall 31 with substantially the same wall thickness as the projecting wall 31. Moreover, the full open stopper 33 projects substantially in the circumferentially radial direction of the projecting wall 31 so as to be disposed substantially in parallel with the axial direction of the shaft 2. Moreover, the full close stopper 35 projects outward from the other peripheral end of the projecting wall 31 with substantially the same wall thickness as the projecting wall 31. Moreover, the full close stopper 35 projects outward substantially in the circumferentially radial direction of the projecting wall 31 and encompasses the periphery of the tapping screw 37.

Moreover, three reinforcing rib portions 34 are formed to project outward from the peripheral surface of the projecting wall 31 substantially in the circumferentially radial direction of the projecting wall 31. Moreover, the reinforcing rib portions 34 project with substantially same thicknesses as the projecting wall 31 in the direction parallel with the circumferential direction of the projecting wall 31. Further, between respective adjoining ones of longitudinal rib portions 36, fallen scraped portions 38 are formed. The bottoms of the fallen scraped portions 38 are the peripheral surface of the projecting wall 31. Further, full open stopper side ends and full close stopper side ends of the reinforcing rib portions 34 are formed thicker to reinforce the reinforcing rib portion 34.

Moreover, three reinforcing rib portions 36 are formed to project from the peripheral surface of the projecting wall 31 substantially in the circumferentially radial direction of the projecting portion. Moreover, the reinforcing rib portions 36 project with substantially the same thicknesses as the projecting wall 31 in parallel with the axial direction of the shaft 2. Further, between respective ones of the reinforcing rib portions 34, fallen scraped portions 39 are formed. The bottoms of the fallen scraped portions 39 are the peripheral surface of the projecting wall 31. Furthermore, a transverse rib portion 36*a* for reinforcing the reinforcing rib portions 36 is formed therebetween.

Hereinafter, the operation of the throttle valve apparatus 100 according to the first embodiment is described with reference to FIGS. 1 to 4A.

When the accelerator pedal is depressed, the throttle lever 3, which is mechanically connected with the accelerator pedal by a wire cable, is rotated by a rotational angle corresponding to depressed degree of the accelerator pedal against biasing force of the return spring 6. Accordingly, since the throttle valve 1 and the shaft 2 are rotated by the same rotational degree as that of the throttle lever 3, the intake air passage 20 is opened by a predetermined open degree. Therefore, the rotational speed of the engine is changed to correspond to the depressed degree of the accelerator pedal.

Moreover, when the accelerator pedal is depressed into the full opened position, the throttle lever 3 rotates in its first rotational direction until the full open stopper portion 43 contacts the full open stopper 33. Therefore, the further rotation of the throttle lever 3 in its first rotational direction is restricted by the full open stopper 33, so that the throttle valve 1 is held in its full opened position inside the bore portion 4. Accordingly, the intake air passage 20 into the engine is fully opened, so that the rotation speed of the engine is heightened.

Moreover, when the accelerator pedal is released, the throttle valve 1, the shaft 2, the throttle lever 3 are returned to respective initial positions by the biasing force of the return spring 6. By the biasing force of the return spring 6, the throttle lever 3 rotates in its second rotational direction until the full close stopper portion 45 contacts the tapping screw 37. Therefore, the further rotation of the throttle lever 3 in the second rotational direction is restricted by the tapping screw 3, so that the throttle valve 1 is held in its full close position inside the bare portion 4. Accordingly, the intake air passage 20 is closed, so that the rotation speed of the engine becomes the idle rotational speed.

As described above, the projecting portion 32 is provided in the throttle valve apparatus 100. In the projecting portion 33, the full open stopper 33, which restricts the rotation of the throttle lever 3 in the first rotational direction when the throttle valve 1 is fully opened, the full close stopper 35, which restricts the rotation of the throttle lever 3 in the second rotational direction when the throttle valve 1 is fully closed, are shared. Accordingly, when the full open stopper 33 is pressed by the throttle lever 3, the load from the throttle lever 3 can be shared to the full closed stopper 35. Moreover, when the full closed stopper 35 is pressed by the throttle lever 3, the load from the throttle lever 3 can be shared to the full open stopper 33. Therefore, the strength of the full open stopper 33 and that of the full closed stopper 35 can be recovered each other. Therefore, the full open stopper 33 and the full closes topper 35 respectively need not be enlarged to keep their strength. Accordingly, the material cost of the heatproof resin can be greatly decreased.

Moreover, the reinforcing rib portions 34 for reinforcing the full open stopper 33 are disposed to be extended in the direction substantially the same as the direction in which the full open stopper 33 receives the load from the throttle lever 3, and the reinforcing rib portions 36 for reinforcing the full close stopper 35 are disposed to be extended in the direction substantially the same as the direction in which the full close stopper 35 receives the load from the throttle lever 3. Accordingly, the section modulus to keep required strength can be easily accomplished, so that the projecting portion 32, including the full open stopper 33, the reinforcing rib portion 34, the full close stopper 35 and the reinforcing rib portion 36, can be downsized.

Moreover, at least the projecting wall 31 and the projecting portion 32 of the throttle housing 5 are integrally formed with the substantially uniform wall thicknesses. Accordingly, the delicate point is not formed in the projecting wall 31 and the projection portion 32. Moreover, the void, which is formed when the throttle housing 5 is formed in the resin molding, and the blow hole, which is formed when the throttle housing 5 is formed in the metal casting, such as the aluminum die-casting, are not formed. Further, it is prevented that the molten resin or the forging liquid does not reach the entire mold cavity of the full open stopper and the full close stopper respectively.

Accordingly, the strength of the full open stopper 33 and the full close stopper 35 are greatly improved, so that the quality of the throttle housing 5, particularly, the qualities of the full open stopper 33 and the full close stopper 35 can be improved. In this way, the performance reductions of the full open stopper 33 and the full close stopper 35 are prevented, and the durability of the full open stopper 33 and the full close stopper 35 can be improved.

Second Embodiment

Figure 5:
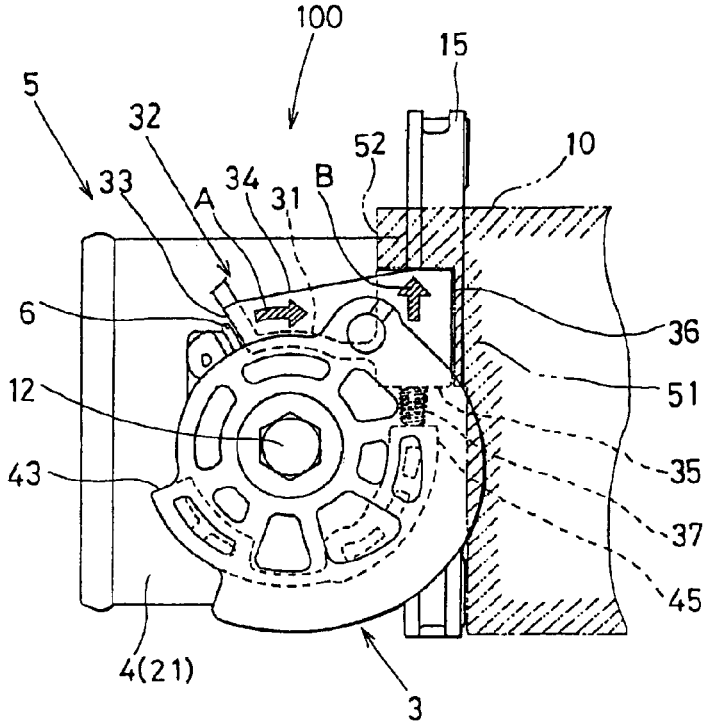
FIG. 5 is a side view of a throttle valve apparatus according to the second embodiment of the present invention.

As shown in FIG. 5, in the throttle valve apparatus 100 according to the second embodiment, the a full open stopper reinforcing portion 51 and a full close stopper reinforcing portion 52 are formed integrally in an attaching end surface of an intake manifold 10. The full open stopper reinforcing portion 51 is for covering the strength of the full open stopper 33, and the full close stopper reinforcing portion 52 is for covering the strength of the full close stopper 35. A side surface of the throttle housing 5 on the downstream side of the intake air is attached to the attaching end surface.

The throttle housing 5 is attached to the attaching end surface of the intake manifold 10, so that the side surface of the projecting portion 32, which is opposite from the full open stopper 33, contacts the full open stopper reinforcing portion 51 of the intake manifold 10. Accordingly, the load into the full open stopper 33, which is caused by the throttle lever 3 when the throttle valve 1 is fully opened, is shared to the full open stopper reinforcing portion 51. Therefore, the full open stopper reinforcing portion 51 can cover the strength of the full open stopper 33. In this way, the full open stopper 33 according to the second embodiment can be further downsized than that according to the first embodiment. Particularly, the reinforcing rib portions 34 for reinforcing the full open stopper 33 can be further downsized in the direction in which receiving the load from the throttle lever 3.

Moreover, the throttle housing 5 is attached to the attaching end surface of the intake manifold 10, so that the end surface of the projecting portion 32, which is opposite from the full close stopper 33, contacts the full close stopper reinforcing portion 52. Accordingly, the load to the full close stopper 35, which is caused by the throttle lever 3, can be shared to the full close stopper reinforcing portion 52. Therefore, the full close stopper reinforcing portion 52 can cover the strength of the full close stopper 35. In this way, the full close stopper 35 according to the second embodiment further downsized than that according to the first embodiment. Particularly, the reinforcing rib portions 36 for reinforcing the full close stopper 35 can be further downsized in the direction in which receiving the load from the throttle lever 3

In this embodiment, one of the full open stopper 33 and the full close stopper 35 may be formed in the projecting wall 31 of the throttle housing 5. In this case, one of the reinforcing rib portion 34 and the reinforcing rib portion 36, for the stopper not provided in the projecting wall 31, need not to be provided.

Third Embodiment

Figure 6:
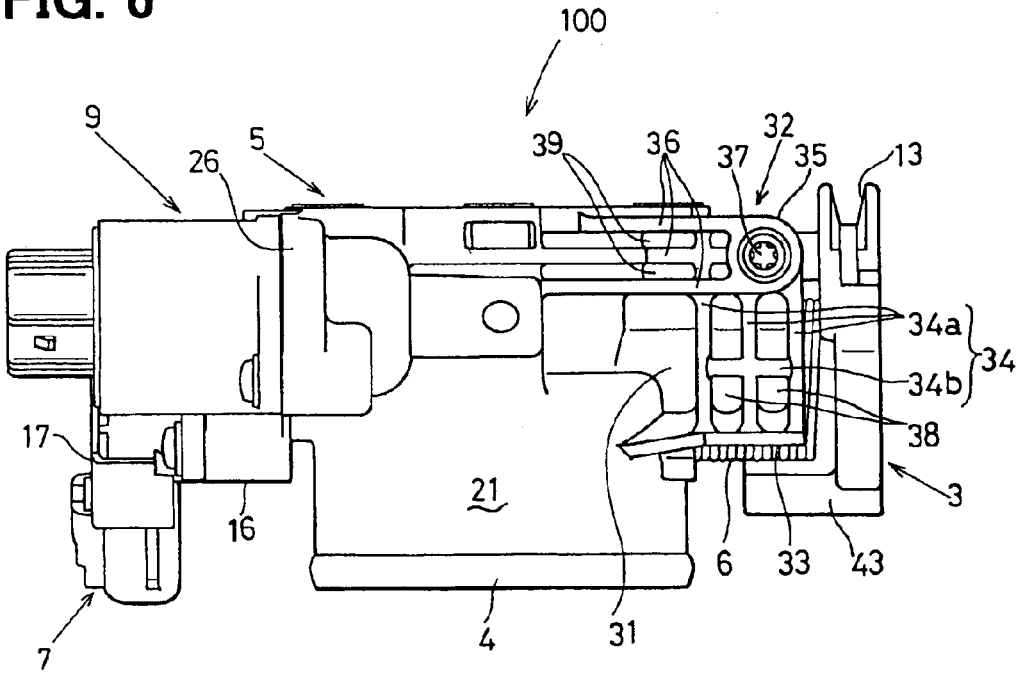
FIG. 6 is a plan view of a throttle valve apparatus according to the third embodiment of the present invention.

The throttle valve apparatus 100 according to the third embodiment is described with reference to FIG. 6.

The reinforcing rib portions 34 according to the third embodiment include three reinforcing rib portions 34*a* and a reinforcing rib portion 34*b* for supporting the reinforcing rib portions 34*a*. The reinforcing rib portions 34*a* are formed to be substantially extended in the direction in which receiving the load from the throttle lever 3. The reinforcing rib portion 34*b* is disposed in the direction substantially perpendicular to the direction in which receiving the load from the throttle lever 3. Similar to the first embodiment, the reinforcing rib portions 34*a*, 34*b* are formed in the substantially same wall thicknesses as the projecting wall 31 and so on. In addition, the reinforcing rib portion 34*b* integrally connects the three reinforcing rib portions 34*a*. A plurality of substantially square spaces surrounded by the three reinforcing ribs 34*a* and the reinforcing rib 34*b* are fallen scraped portions 38.

Moreover, reinforcing rib portions 36, for reinforcing the full close stopper 35, may be formed in the structure similar to the reinforcing rib portions 34*a*, 34*b*.

Fourth Embodiment

Figure 7:
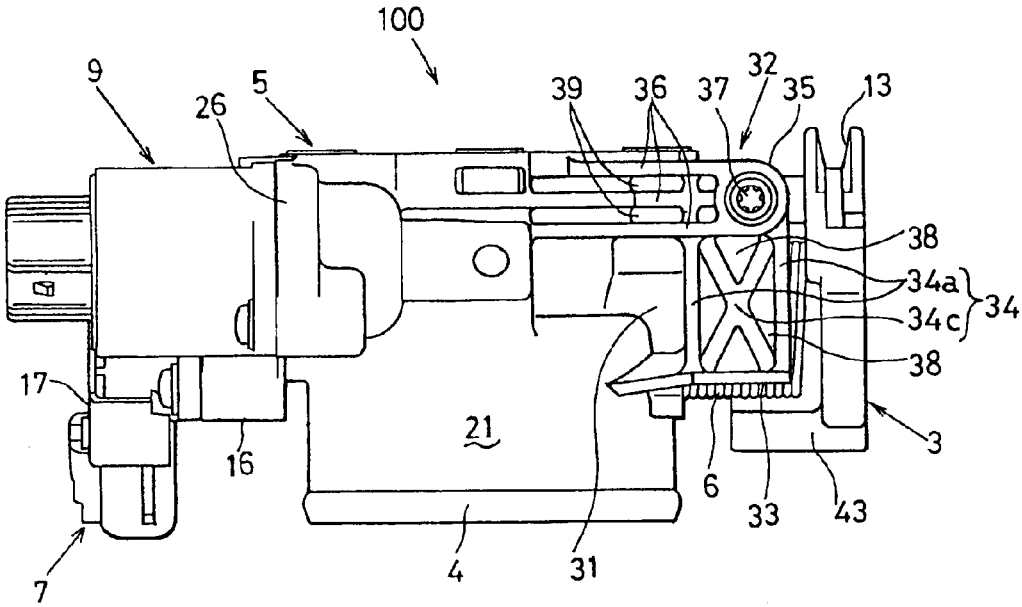
FIG. 7 is a plan view of a throttle valve apparatus according to the fourth embodiment of the present invention.

The throttle valve apparatus 100 according to the fourth embodiment is described with reference to FIG. 7.

The reinforcing rib portions 34 according to this embodiment include two reinforcing rib portions 34*a* and two crossed reinforcing rib portions 34*c* for supporting the reinforcing rib portions 34*a*. The reinforcing rib portions 34*a* are disposed to be extended in the direction substantially the same as the direction in which receiving the load from the throttle lever 3. Similar to the first embodiment, the reinforcing rib portions 34*a*, 34*c* are formed in the substantially same thickness as the projecting wall 31 and soon. The reinforcing rib portions 34*c* are crossly formed to integrally connect the two reinforcing rib portions 34*a*. Moreover, a plurality of substantially triangular spaces surrounded by the reinforcing rib portions 34*a* and the reinforcing rib portions 34*c* are fallen scraped portions 38.

Moreover, the reinforcing rib portions 36, for reinforcing the full close stopper 35, may be formed in the structure similar to the reinforcing rib portions 34*a*, 34*c*.

Fifth Embodiment

Figure 8:
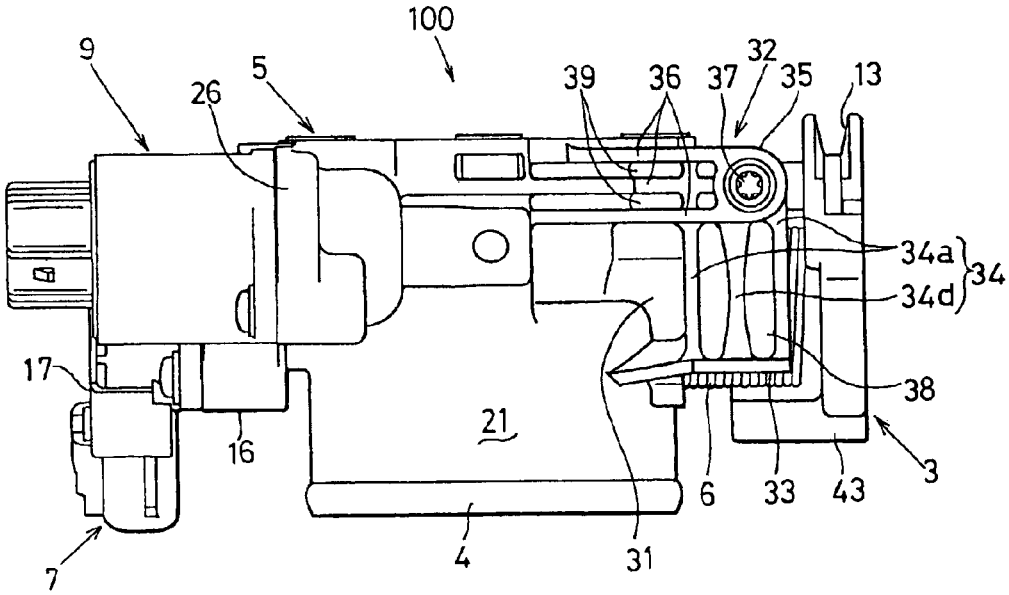
FIG. 8 is a plan view of a throttle valve apparatus according to the fifth embodiment of the present invention.

The throttle valve apparatus 100 according to the fifth embodiment is described with reference to FIG. 8.

The reinforcing rib portions 34 according to this embodiment include two reinforcing rib portions 34*a* and one reinforcing rib portion 34*d* for covering the strength around both attaching ends of the reinforcing rib portions 34. The reinforcing rib portions 34*a* are extended in the direction substantially the same as the direction in which receiving the load from the throttle lever 3. Both attaching ends of the reinforcing rib portion 34*d* are formed thicker than its middle portion, so as to reinforce the strength of the attaching ends. A plurality of spaces surrounded by the reinforcing rib portions 34*a* and the reinforcing rib portion 34*d* are fallen scraped portions 38.

Moreover, the reinforcing rib portions 36, which reinforce the full close stopper 35, may be formed in the structure similar to the reinforcing rib portions 34*a*, 34*d*.

Other Embodiments

In the above embodiments, the present invention is employed for the throttle valve apparatus 100, in which the throttle valve 1 and the shaft 2 are operated by the wire cable connected to the accelerator pedal. The depressing degree of the accelerator pedal is mechanically communicated with the throttle valve 1 and the shaft 2 through the wire cable. However, the present invention may be employed for a throttle control system, in which a valve gear, serving as the throttle lever, is rotationally driven by a motor through a gear system. In this case, the valve gear may be engaged with the end of the shaft 2 by a fastening member, such as a screw, or the valve gear may be integrally formed in the end of the shaft 2.

Moreover, the outlet of the PCV, the opening degree of which is controlled by a PCV valve, may be formed in the air intake passage of the engine.

Moreover, in the above embodiments, the throttle housing 5 is integrally formed of the heatproof resin. However, the throttle housing 5 may be integrally formed of the die-cast aluminum or the metal material. Moreover, the throttle valve 1 and the shaft 2 are made of the metal material. However, the throttle valve 1 and the shaft 2 may be integrally made of the heatproof resin material.

Moreover, the tapping screw 37 for controlling the fully closed position of the throttle valve 1 is engaged with the full close stopper 35. However, the tapping screw 37 need not be formed in the full close stopper 35. Moreover, the tapping screw 37 for controlling the fully opened position of the throttle valve 1 may be engaged with the full open stopper 33.

In the above embodiments, the bore portion 4 is formed in the double-piped structure, in which the cylindrical inner bore pipe 22 is disposed inside the cylindrical outer bore pipe 21 and in which the axis of the inner bore pipe 22 is shifted upper than that of the outer bore pipe 21 in the vertical direction. However, the bore portion 4 may be formed in a double-piped structure, in which the cylindrical inner bore pipe 22 is disposed inside the cylindrical outer bore pipe 21, and in which the axis of the inner bore pipe 22 is shifted lower than that of the outer bore pipe 21 in the vertical direction. Moreover, the outer bore pipe 21 and the inner bore pipe 22 may be disposed concentrically. Further, the bore portion 4 may be formed in a single piped structure.

Figure 4B:
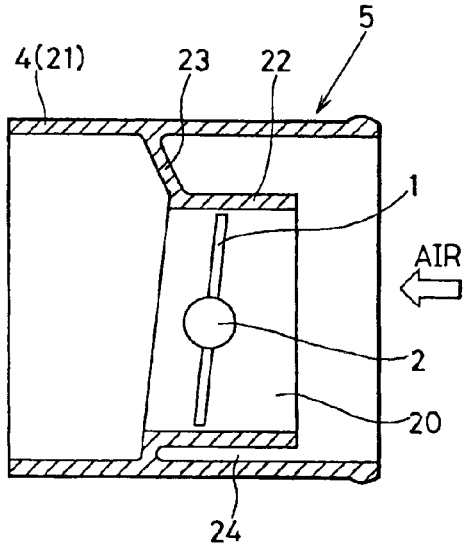
FIG. 4B is a cross-sectional view of a bore portion of a throttle valve apparatus according to the other embodiment.

Moreover, in the above embodiments, as shown in FIG. 4A, the sealing concavities 24, 25, for sealing the bore portion 4 from water flowing thereinto are formed inside the bore portion 4. Accordingly, icing of the throttle valve 1 in a cold season is prevented without leading the coolant to the throttle housing 5 and increasing the number of its components. However, as shown in FIG. 4B, only the sealing concavity 24 for at least sealing the water taken from the air intake line may be formed.

The present invention should not be limited to the embodiments previously discussed and shown in the figures, but may be implemented in various ways without departing from the spirit of the invention.

What is claimed is:

1. A throttle valve apparatus for an engine, the throttle valve apparatus comprising:

a throttle valve, which controls an amount of air taken into the engine;

a throttle shaft, which rotates with the throttle valve;

a rotative member, which is fixed with respect to one end portion of the throttle shaft and rotates the throttle shaft; and a throttle housing comprising:

a bore portion, which stores the throttle valve openably and closably;

a projecting wall, which is disposed outside the bore portion and partially covers the one end portion of the throttle shaft; and a projecting portion, which projects outward from a peripheral surface of the projecting wall in a radial direction of the projecting wall, wherein: the bore portion, the projecting wall and the projecting portion are integrally molded in one piece to comprise the throttle housing; and the projecting portion integrally has:

a full open stopper, which restricts rotation of the rotative member in its first rotational direction when the throttle valve is fully opened; and a full close stopper, which restricts rotation of the rotative member in its second rotational direction, which is opposite to the first rotational direction, when the throttle valve is fully closed.

2. The throttle valve apparatus according to claim 1, wherein:

the projecting portion has a reinforcing rib portion, which reinforces at least one of the full open stopper and the full close stopper; and the reinforcing rib portion extends generally in a direction, in which the at least one of the full open stopper and the full close stopper receives a load from the rotative member.

3. The throttle valve apparatus according to claim 2, wherein:

the throttle housing is one of a resin molded throttle housing, which is integrally made of a resin material, and a metal cast throttle housing, which is integrally made of a metal material; and at least the projecting wall, the reinforcing rib portion, the full open stopper and the full close stopper of the throttle housing are formed in substantially uniform wall thicknesses.

4. The throttle valve apparatus according to claim 1, wherein the rotative member is one of a throttle lever, which is fastened to the one end of the throttle shaft by a fastening member, and a valve gear, which is integrally formed in the one end of the throttle shaft.

5. A throttle valve apparatus for an engine, the throttle valve apparatus comprising:

a throttle valve, which controls an amount of air taken into the engine;

a throttle shaft, which rotates with the throttle valve;

a rotative member, which is fixed with respect to one end portion of the throttle shaft and rotates the throttle shaft; and a throttle housing comprising:

a bore portion, which stores the throttle valve openably and closably;

a projecting wall, which is disposed outside the bore portion and partially covers the one end portion of the throttle shaft; and a projecting portion, which projects outward from a peripheral surface of the projecting wall in a radial direction of the projecting wall, wherein:

the bore portion, the projecting wall and the projecting portion are integrally molded in one piece to comprise the throttle housing; and the projecting portion has a full open stopper, which restricts rotation of the rotative member in its first rotational direction when the throttle valve is fully opened; and wherein the engine has an engine side component to be airtightly connected with the throttle housing; and the throttle housing is attached to the engine side component, so that one side of the projecting portion, which is opposite from the full open stopper, contacts the engine side component.

6. The throttle valve apparatus according to claim 5, wherein:

the projecting portion has a reinforcing rib portion for reinforcing the full open stopper; and the reinforcing rib portion is disposed at least to be extended substantially in a direction in which the full open stopper receives a load from the rotative member.

7. The throttle valve apparatus according to claim 6, wherein:

the throttle housing is one of a resin molded throttle housing, which is integrally made of a resin material, and a metal cast throttle housing, which is integrally made of a metal material; and at least the projecting wall, the reinforcing rib portion, the full open stopper and the full close stopper of the throttle housing are formed in substantially uniform wall thickness.

8. A throttle valve apparatus for an engine, the throttle valve apparatus comprising:

a throttle valve, which controls an amount of air taken into the engine;

a throttle shaft, which rotates with the throttle valve;

a rotative member, which is fixed with respect to one end portion of the throttle shaft and rotates the throttle shaft; and a throttle housing comprising:

a bore portion, which stores the throttle valve openably and closably;

a projecting wall, which is disposed outside the bore portion and partially covers the one end portion of the throttle shaft; and a projecting portion, which projects outward from a peripheral surface of the projecting wall in a radial direction of the projecting wall, wherein:

the bore portion, the projecting wall and the projecting portion are integrally molded in one piece to comprise the throttle housing;

the projecting portion has a full close stopper, which restricts rotation of the rotative member in its second rotational direction when the throttle valve is fully closed; and wherein the engine has an engine side component to be airtightly connected with the throttle housing; and the throttle housing is attached to the engine side component, so that one side portion of the projecting portion, which is opposite from the full close stopper, contacts the engine side component.

9. The throttle valve apparatus according to claim 8, wherein:

the projecting portion has a reinforcing rib portion for reinforcing the full close stopper; and the reinforcing rib portion is disposed at least to be extended substantially in a direction in which the full close stopper receives a load from the rotative member.

* * * * *